US007884779B2

(12) United States Patent
Haziza

(10) Patent No.: US 7,884,779 B2
(45) Date of Patent: Feb. 8, 2011

(54) MULTIPLE-INPUT SWITCH DESIGN

(75) Inventor: Dedi David Haziza, San Jose, CA (US)

(73) Assignee: Wavebender, Inc., Santa Clara, CA (US)

( * ) Notice: Subject to any disclaimer, the term of this patent is extended or adjusted under 35 U.S.C. 154(b) by 575 days.

(21) Appl. No.: 11/941,754

(22) Filed: Nov. 16, 2007

(65) Prior Publication Data

US 2008/0316142 A1 Dec. 25, 2008

Related U.S. Application Data

(63) Continuation-in-part of application No. 11/695,913, filed on Apr. 3, 2007, now Pat. No. 7,466,281.

(60) Provisional application No. 60/859,667, filed on Nov. 17, 2006, provisional application No. 60/859,799, filed on Nov. 17, 2006, provisional application No. 60/890,456, filed on Feb. 16, 2007.

(51) Int. Cl.
*H01Q 3/24* (2006.01)

(52) U.S. Cl. ..... 343/876

(58) Field of Classification Search ..... 343/754, 343/700 MS, 876, 893
See application file for complete search history.

(56) References Cited

U.S. PATENT DOCUMENTS

| | | | | |
|---|---|---|---|---|
| 3,818,490 | A | 6/1974 | Leahy | |
| 3,942,180 | A | 3/1976 | Rannou et al. | |
| 4,359,741 | A * | 11/1982 | Cassel | 343/754 |
| 4,644,343 | A | 2/1987 | Schneider et al. | |
| 4,783,665 | A | 11/1988 | Lier et al. | |
| 5,793,334 | A | 8/1998 | Anderson et al. | |
| 5,943,023 | A | 8/1999 | Sanford | |
| 7,042,397 | B2 * | 5/2006 | Charrier et al. | 343/700 MS |
| 2003/0038745 | A1 | 2/2003 | Lalezari et al. | |
| 2003/0122724 | A1 | 7/2003 | Shelley et al. | |
| 2004/0246069 | A1 | 12/2004 | Yoneda et al. | |
| 2005/0146478 | A1 | 7/2005 | Wang et al. | |
| 2005/0174290 | A1 | 8/2005 | Huang | |
| 2005/0219126 | A1 | 10/2005 | Rebeiz et al. | |
| 2006/0050006 | A1 | 3/2006 | Weit | |
| 2006/0055605 | A1 | 3/2006 | Peled et al. | |
| 2009/0231223 | A1 * | 9/2009 | Laronda | 343/748 |

OTHER PUBLICATIONS

International Search Report for PCT Application No. PCT/US07/24047 dated May 2, 2008.

International Search Report for PCT Application No. PCT/US07/12004 dated Jul. 7, 2008.

(Continued)

*Primary Examiner*—Tan Ho
(74) *Attorney, Agent, or Firm*—Nixon Peabody LLP.; Joseph Bach, Esq.

(57) ABSTRACT

A switch designs having very low insertion loss, in which the insertion loss remains the same regardless of the number of inputs. A plurality of inputs are structured for receiving electromagnetic radiation signal having a wavelength λ. A plurality of switches, e.g., PIN diode switches, are coupled to a respective input. A main conductor is coupled to an output. A plurality of leg conductors are coupled at one end to the main conductor and at other end to a respective switch from the plurality of switches, wherein each of the leg conductors has a length substantially equal to nλ/2, wherein n is a whole natural number.

18 Claims, 3 Drawing Sheets

OTHER PUBLICATIONS

International Search Report for PCT Application No. PCT/US07/24027 dated May 14, 2008.

International Search Report for PCT Application No. PCT/US07/24028 dated May 20, 2008.

International Search Report for PCT Application No. PCT/US07/24029 dated May 14, 2008.

International Search Report for PCT Application No. PCT/US07/08418 dated Jul. 8, 2008.

Forward, Troy "Steep Wall Monitoring Using Switched Antenna Arrays and Permanent GPS Networks," Department of Spatial Sciences, Curtin University of Technology, Perth, Western Australia, Mar. 19-21, 2001, Orange, CA.

Kwakkernaat, M.R.J.A.E., "3-D Switched Antenna Array for Angle-of-Arrival Measurements," Proc. 'EuCAP 2006', Nice, France, Nov. 6-10, 2006 (ESA SP-626, Oct. 2006).

International Search Report for International Patent Application No. PCT/US2007/024210 (Nov. 10, 2008).

* cited by examiner

MULTIPLE-INPUT SWITCH DESIGN

CROSS-REFERENCE TO RELATED APPLICATIONS

This application is a continuation of and claims priority from U.S. application Ser. No. 60/859,667, filed Nov. 17, 2006; U.S. application Ser. No. 60/859,799, filed Nov. 17, 2006; and U.S. application Ser. No. 60/890,456, filed Feb. 16, 2007, this Application is further a continuation-in-part and claims priority from U.S. Application Ser. No. 11/695,913, filed Apr. 3, 2007, now U.S. Pat. No. 7,466,281 the disclosure of all of which is incorporated herein by reference in its entirety.

BACKGROUND

1. Field of the Invention

The general field of the invention relates to a unique multiple input switch design, particularly suitable for electromagnetic radiation applications, such as multiple antenna or multiple radiation beam applications.

2. Related Arts

Various antenna arrangements require switching among multiple antennas to a single or multiple reception circuitries. For example, some antennas may have multiple selectable inputs/outputs for beam steering or directing. Other applications may have an array of antennas, only one of which is coupled to receiver/transmitter at a time. FIG. 1 illustrates a cascading switch array for coupling one of inputs $I_1$-$I_4$ to an output $O_1$. The cascading switch array is made out of switches, e.g., PIN diode switches, $S_1$-$S_7$. To connect one of inputs $I_1$-$I_4$ to output $O_1$, each of the switches $S_1$-$S_7$ assumes either a closed (short) or open position. For example, to connect input $I_1$ to the output, switches $S_1$, $S_5$, and $S_7$ assume the closed position, while the remaining switches assume the open position.

Antenna gain is an important characteristic of any transmission system. However, switches, such as PIN diode switches, have intrinsic insertion loss. For example, InGaAs/InP PIN diodes have been reported to have about 1.2 db insertion loss, while commercially available Agilent P940xA/C Solid State PIN diode switches are reported by the vendor to have 2.5 db insertion loss at 4 GHz. As can be seen from FIG. 1, when using a cascading switch arrangement, the insertion loss is compounded by the need to have several switches in the path. The example of FIG. 1, is used to connect one of only four possible inputs to the output, and necessitates three switches to be present in the path, tripling the insertion loss of the system. The insertion loss becomes even more acute if more inputs are required.

Accordingly, there is a need in the art for a switch design that minimizes insertion loss. Additionally, there is a need in the art for a switch design in which the insertion loss is not dependent on the number of inputs.

SUMMARY

The following summary of the invention is provided in order to provide a basic understanding of some aspects and features of the invention. This summary is not an extensive overview of the invention, and as such it is not intended to particularly identify key or critical elements of the invention, or to delineate the scope of the invention. Its sole purpose is to present some concepts of the invention in a simplified form as a prelude to the more detailed description that is presented below.

Embodiments of the invention provide switch designs having very low insertion loss. Moreover, embodiments of the invention provide switch designs in which the insertion loss remains the same, regardless of the number of inputs.

According to aspects of the invention, a switch arrangement for electromagnetic radiation applications is provided, comprising: a plurality of inputs, each structured for receiving electromagnetic radiation signal having a wavelength $\lambda$; a plurality of switches, each coupled to a respective input from the plurality of inputs; a main conductor coupled to an output; and a plurality of leg conductors, each coupled at one end to the main conductor and at its other end to a respective switch from the plurality of switches, each of the leg conductors having a length substantially equal to $n\lambda/2$, wherein n is a whole natural number. The central conductor may comprise a linear conductor, and the plurality of leg conductors may be connected to the linear conductor at intervals equaling $m\lambda/2$, wherein m is a whole natural number. Each of the plurality of switches may comprise a PIN diode switch. The main conductor and each of the leg conductors may comprise microstrip or stripline. The main conductor may comprise a circular conductor. The switch may further comprise an output lead coupled to the center of the circular conductor. The circular conductor may comprise a capacitor plate.

According to other aspects of the invention, a switch arrangement for electromagnetic radiation applications is provided, comprising: a plurality of inputs, each structured for receiving electromagnetic radiation signal having a wavelength $\lambda$; an insulative substrate; a main conductive trace formed on the insulative substrate and coupled to an output; a plurality of switches affixed to the insulative substrate, each coupled to a respective input from the plurality of inputs; and a plurality of conductive leg traces formed on the insulative substrate, each coupled at one end to the main conductive trace and at its other end to a respective switch from the plurality of switches, each of the leg traces having a length substantially equal to $n\lambda/2$, wherein n is a whole natural number. The main conductive trace may comprise a linear trace, and the plurality of leg traces may be connected to the linear trace at intervals equaling $m\lambda/2$, wherein m is a whole natural number. Each of the plurality of switches may comprise a PIN diode switch. The main conductive trace may comprise a circular conductive patch. The switch arrangement may further comprise an output lead coupled to the center of the circular conductive patch. The circular conductive patch may comprise a capacitor plate.

According to aspects of the invention, a method for fabricating a switch arrangement for electromagnetic radiation applications is provided, comprising: determining a wavelength $\lambda$ of the electromagnetic radiation; providing an insulative substrate; forming a main conductive trace on the insulative substrate; affixing a plurality of switches to the insulative substrate; and forming a plurality of conductive leg traces on the insulative substrate, and coupling each at one end to the main conductive trace and at its other end to a respective switch from the plurality of switches, wherein each of the leg traces is formed to have a length substantially equal to $n\lambda/2$, wherein n is a whole natural number. Forming the main conductive trace may comprise forming a linear trace and connecting the plurality of leg traces to the linear trace at intervals equaling $m\lambda/2$, wherein m is a whole natural number. Forming the main conductive trace may comprise forming a circular patch. The method may further comprise connecting an output lead to the center of the circular patch.

According to further aspects of the invention, a method for operating a plurality of radiation sources for steering a radiation beam from a receiver is provided, comprising: activating a switch to couple a first radiation sources to the receiver and decoupled all other radiation sources from the receiver, and receiving radiation solely from the first radiation source; activating the switch to couple a second radiation source to the transceiver without decoupling the first radiation source from, the transceiver, and receiving radiation from the first and second radiation sources in additive mode; and decoupling the first radiation source from the receiver, and receiving radiation solely from the second radiation source.

BRIEF DESCRIPTION OF THE DRAWINGS

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

DETAILED DESCRIPTION

Various embodiments of the invention are generally directed to a switch design enabling selective connection of one or more inputs from a series of available inputs. The inventive switch design has insertion loss that is not dependent on the number of available inputs, or the number of connected inputs.

Figure 1:
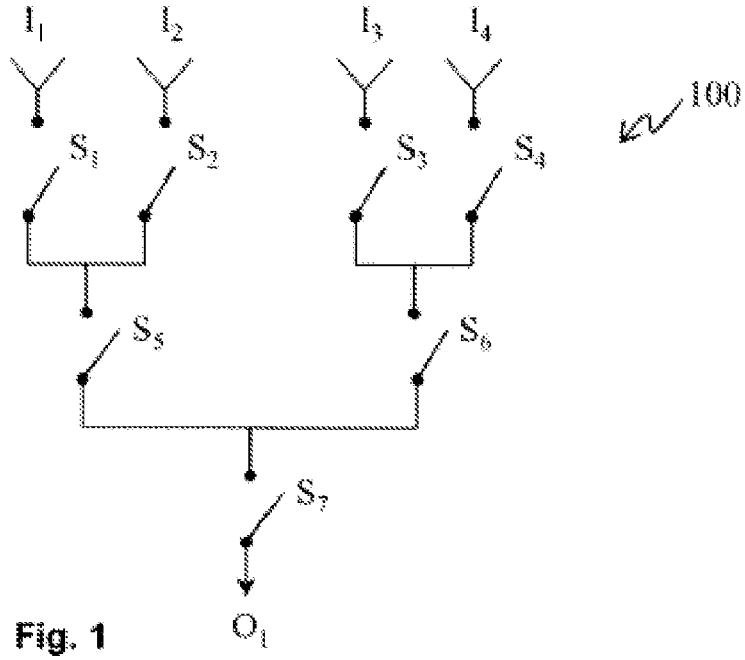
Fig. 1 PRIOR ART
FIG. 1 illustrates a cascading switch arrangement according to the prior art.
Figure 2:
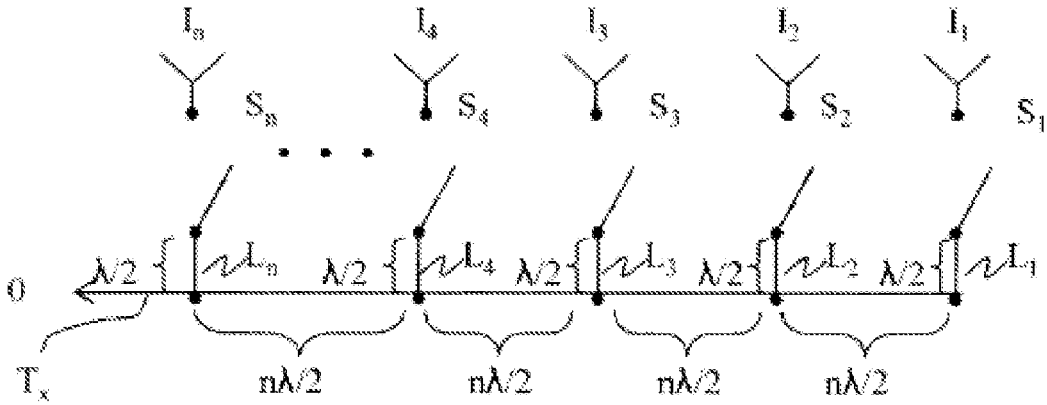
FIG. 2 is a diagram conceptualizing a switch arrangement according to the invention.

FIG. 2 is a diagram conceptualizing a switch arrangement according to the invention. In the embodiment of FIG. 2, n inputs, $I_1$-$I_n$, are made available to be connected to the output, O, via switches $S_1$-$S_n$. In this arrangement, each switch $S_1$-$S_n$, is connected to a conductor leg $L_1$-$L_n$, which in turn is connected to the main transmission line Tx. Conductor legs $L_1$-$L_n$, and main transmission line Tx may be made using, e.g., conventional microstrip, stripline, or other transmission line technology. When the conductors and transmission lines described herein are made using microstrip or stripline technology, they may simply be referred to as conductive traces.

Each conductor leg measures $\lambda/2$, so that the condition of the switch is reflected at the point of connection of the leg L to the main transmission line Tx. That is, the same electric field and magnetic field existing at the switch are projected onto the point of connection of the leg L to the main transmission line. Thus, for example, if the switch is in the open position, then at the switch the electric field is zero, E=0. Since the length of leg L is $\lambda/2$, the electric field at the point connecting the leg to the main transmission line is also zero. Of course, the length of the leg L may be a multiple of length $\lambda/2$, i.e., it may be n $\lambda/2$, where n is a whole number. Similarly, the distance between any two leg connections on the transmission line is also set to $\lambda/2$, or more precisely, m $\lambda/2$, wherein m is a whole number not necessarily equal to n.

As can be understood from the above explanation, in the embodiment of FIG. 2, one or more of inputs $I_1$-$I_n$ may be connected to the output. However, regardless of how many input are made available or of how many inputs are connected at any given time, the total insertion loss always equals the insertion loss of a single switch $S_1$-$S_n$.

Figure 3:
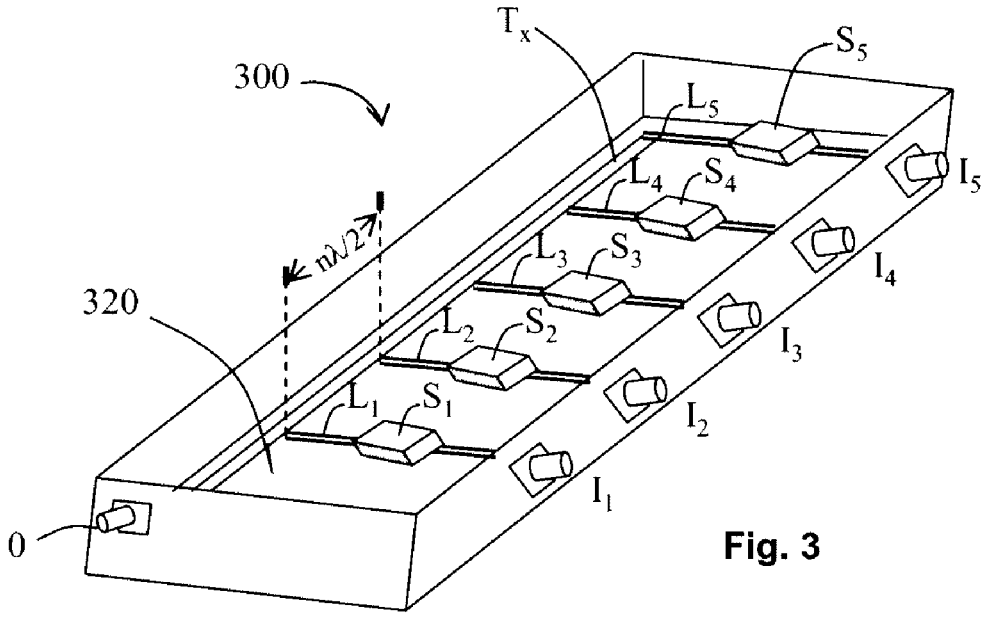
FIG. 3 is an example of a linear switch according to an embodiment of the invention.

FIG. 3 is an example of a linear switch 300 according to an embodiment of the invention, with its top removed so that internal elements can be seen. The switch 300 has five inputs, $I_1$-$I_5$, and one output, O. Inside the switch, a main transmission line, Tx, is formed using, e.g., microstrip or stripline technology, over an insulative substrate 320. Conductive legs $L_1$-$L_5$, are connected to the main transmission line Tx, along points that are separated by $n\lambda/2$. Each of the leg $L_1$-$L_5$, is of length $m\lambda/2$, wherein n and m are natural whole numbers and need not be the same. On each leg $L_1$-$L_5$, a switch $S_1$-$S_5$, such as a PIN diode, is connected at the other end, opposite the end connected to the main transmission line Tx.

Figure 4:
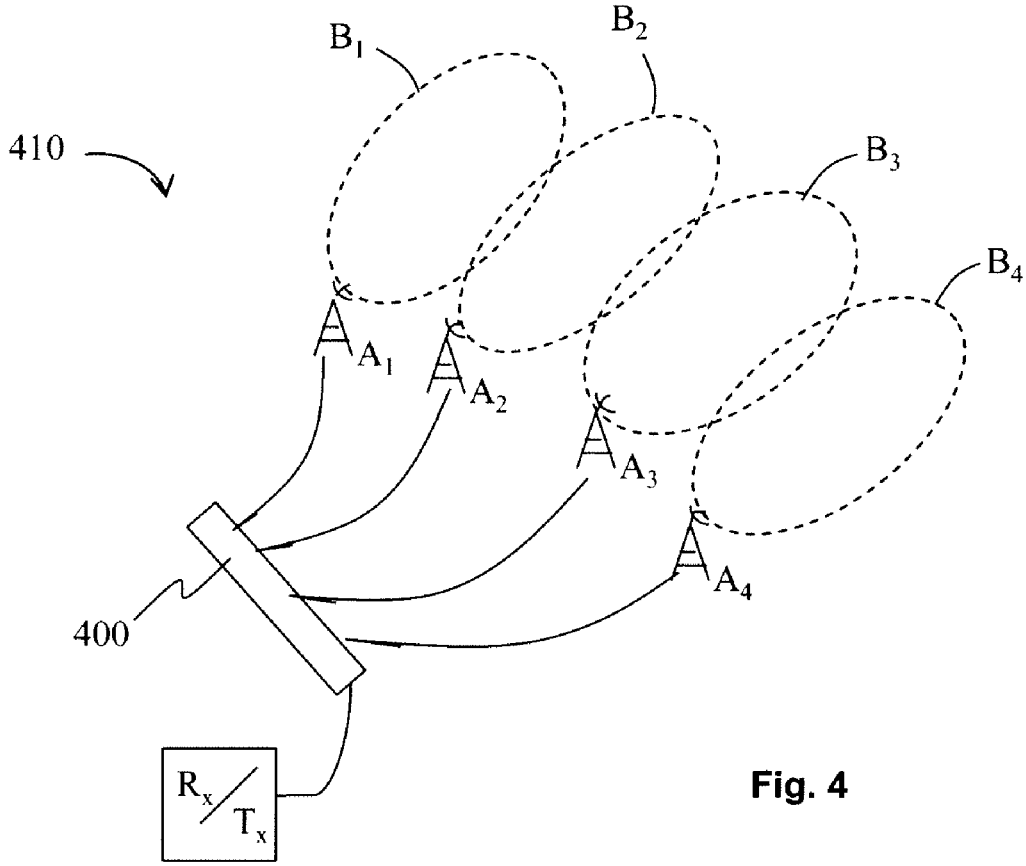
FIG. 4 illustrates a switched antenna array utilizing a switch according to embodiment of the invention.

FIG. 4 illustrates a switched antenna array 410 utilizing a switch 400 according to embodiment of the invention. The antenna array comprises of four antennas, A1-A4, each having main beam B1-B4, aimed at a particular direction in space. The switch 400 is constructed according to any of the embodiments described herein, or according to the principles of the invention as described herein. The switched may be used so that one antenna may be selected at a time, so as to transmit or receive towards one direction in space. The antennas may also be polled sequentially to cover a large swath of space. Also, when using the antennas in a sequential polling mode, such as, for example, when tracking a moving object, the inventive switch may be used according to the following method.

That is, rather than switching from one antenna to the next in the sequence, first the second antenna in the sequence is connected. Due to the special design of the switch, wherein each leg's length and separation is $n\lambda/2$, the resulting signal from the two antennas is the sum of their signal. Then, the first antenna is disconnected, so that the resulting signal is that of the second antenna. In this manner, no "jump" or discontinuity results in reception or in space, rather tracking is done smoothly and continuously. That is, using the inventive switch in essence provides three positions, or three types of signals, for every two antennas.

Figure 5:
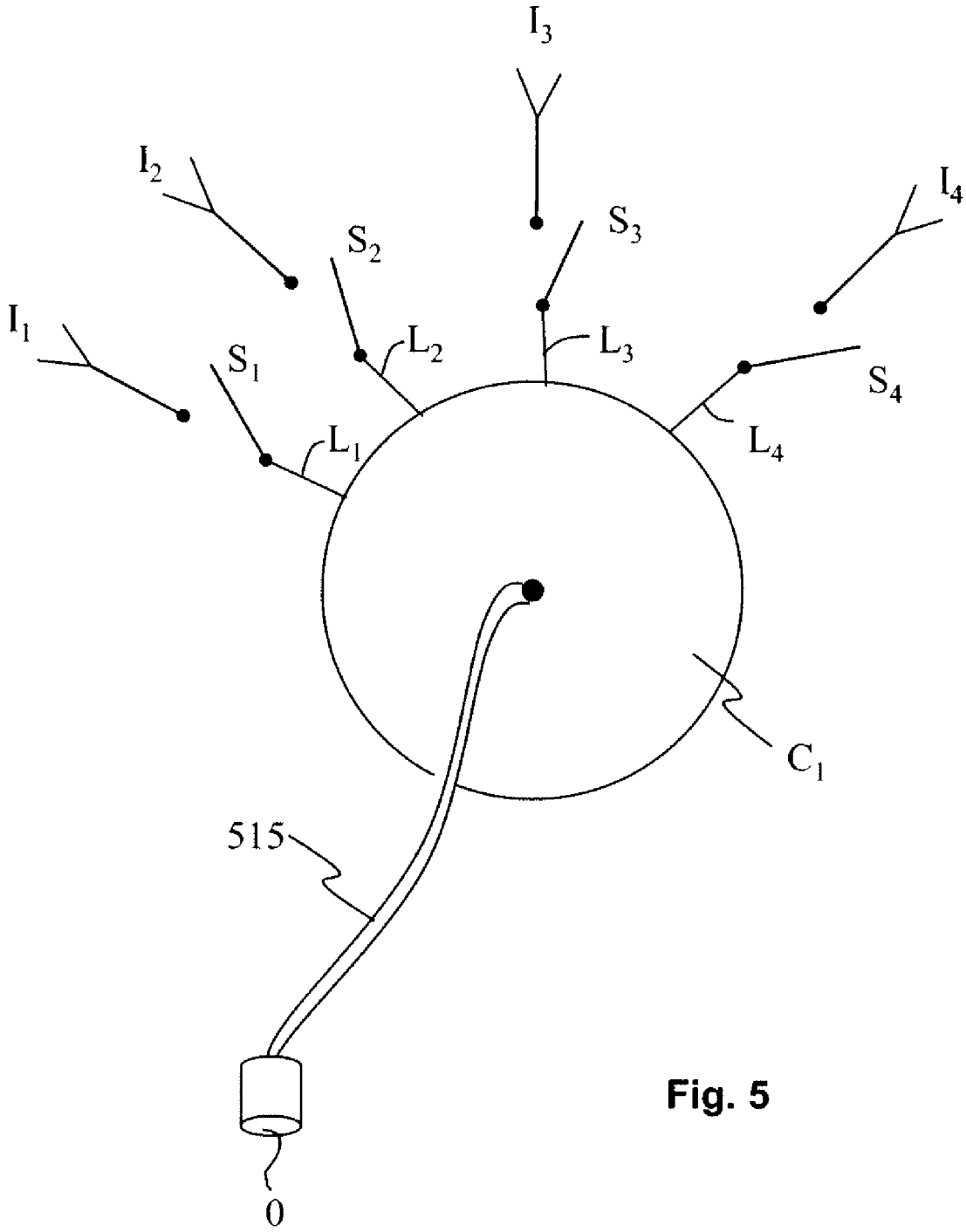
FIG. 5 illustrates an embodiment of a switch array according to the invention, which unloads capacitance from the individual switches.

Another problem that is known in the art is that conventional switches, such as PIN diode switches behave somewhat as capacitors. This may present an unacceptable load at the output of the main line Tx. FIG. 5 illustrates an embodiment of a switch array according to the invention, which unloads charge from the individual switches. The switch is made of one central conductor in the form of a circular patch C1, made by, for example, microstrip or stripline technology. The circular conductor serves as a large capacitor, capable of unloading the charge on the individual switches $S_1$-$S_4$. The switches $S_1$-$S_4$, are connected to the central conductor C1 by conductors $L_1$-$L_4$. The length of each conductor $L_1$-$L_4$, is $n\lambda/2$. In this manner, the condition of the each individual switch $S_1$-$S_4$, is reflected to the point of connection of each leg $L_1$-$L_4$, to the central conductor C1. Lead 515 is connected to the center of conductor C1 to form the output of the switch.

Notably, due to the circular geometry of the central conductor C1, the space separating each connection of one of legs $L_1$-$L_4$, to another is immaterial. As long as the length of each leg $L_1$-$L_4$, is kept to $n\lambda/2$, this switch will enable selecting any connection combination of the inputs $I_1$-$I_4$, to the output lead 515. Moreover, the capacitance of the individual switches $S_1$-$S_4$, would not load the output, as it will be absorbed by the central conductor C1.

Finally, it should be understood that processes and techniques described herein are not inherently related to any particular apparatus and may be implemented by any suitable combination of components. Further, various types of general purpose devices may be used in accordance with the teachings described herein. It may also prove advantageous to construct specialized apparatus to perform the method steps described herein. The present invention has been described in relation to particular examples, which are intended in all respects to be illustrative rather than restrictive. Those skilled in the art will appreciate that many different combinations of hardware, software, and firmware will be suitable for practicing the present invention. For example, the described software may be implemented in a wide variety of programming or scripting languages, such as Assembler, C/C++, perl, shell, PHP, Java, HFSS, CST, EEKO, etc.

The present invention has been described in relation to particular examples, which are intended in all respects to be illustrative rather than restrictive. Those skilled in the art will appreciate that many different combinations of hardware, software, and firmware will be suitable for practicing the present invention. Moreover, other implementations of the invention will be apparent to those skilled in the art from consideration of the specification and practice of the invention disclosed herein. It is intended that the specification and examples be considered as exemplary only, with a true scope and spirit of the invention being indicated by the following claims. It should also be noted that antenna radiation is a two-way process. Therefore, any description herein for transmitting radiation is equally applicable to reception of radiation and vice versa. Describing an embodiment with using only transmission or reception is done only for clarity, but the description is applicable to both transmission and reception.

The invention claimed is:

1. A switch arrangement for electromagnetic radiation applications, comprising:

a plurality of inputs, each structured for receiving electromagnetic radiation signal having a wavelength $\lambda$;

a plurality of switches, each coupled to a respective input from the plurality of inputs;

a main conductor coupled to an output lead;

a plurality of leg conductors, each coupled at one end to the main conductor and at its other end to a respective switch from the plurality of switches, each of the leg conductors having a length substantially equal to $n\lambda/2$, wherein n is a whole natural number.

2. The switch arrangement of claim 1, wherein the central conductor comprises a linear conductor, and wherein the plurality of leg conductors are connected to the linear conductor at intervals equaling $m\lambda/2$, wherein m is a whole natural number.

3. The switch arrangement of claim 1, wherein each of the plurality of switches comprises a PIN diode switch.

4. The switch arrangement of claim 1, wherein the main conductor and each of the leg conductors comprise one of microstrip or stripline.

5. The switch arrangement of claim 1, wherein the main conductor comprises a circular conductor.

6. The switch arrangement of claim 5, wherein the output lead is coupled to the center of the circular conductor.

7. The switch arrangement of claim 6, wherein the circular conductor comprises a capacitor plate.

8. A switch arrangement for electromagnetic radiation applications, comprising:

a plurality of inputs, each structured for receiving electromagnetic radiation signal having a wavelength $\lambda$;

an insulative substrate;

a main conductive trace formed on the insulative substrate and coupled to an output lead;

a plurality of switches affixed to the insulative substrate, each coupled to a respective input from the plurality of inputs;

a plurality of conductive leg traces formed on the insulative substrate, each coupled at one end to the main conductive trace and at its other end to a respective switch from the plurality of switches, each of the leg traces having a length substantially equal to $n\lambda/2$, wherein n is a whole natural number.

9. The switch arrangement of claim 8, wherein the main conductive trace comprises a linear trace, and wherein the plurality of leg traces are connected to the linear trace at intervals equaling $m\lambda/2$, wherein m is a whole natural number.

10. The switch arrangement of claim 8, wherein each of the plurality of switches comprises a PIN diode switch.

11. The switch arrangement of claim 8, wherein the main conductive trace comprises a circular conductive patch.

12. The switch arrangement of claim 11, wherein the output lead is coupled to the center of the circular conductive patch.

13. The switch arrangement of claim 12, wherein the circular conductive patch comprises a capacitor plate.

14. A method for fabricating a switch arrangement for electromagnetic radiation applications, comprising:

determining a wavelength $\lambda$ of the electromagnetic radiation;

providing an insulative substrate;

forming a main conductive trace on the insulative substrate;

coupling an output terminal to the main conductive trace;

affixing a plurality of switches to the insulative substrate;

coupling a plurality of input terminals, one to each respective switch from the plurality of switches;

forming a plurality of conductive leg traces on the insulative substrate, and coupling each at one end to the main conductive trace and at its other end to a respective switch from the plurality of switches, wherein each of the leg traces is formed to have a length substantially equal to $n\lambda/2$, wherein n is a whole natural number.

15. The method of claim 14, wherein forming the main conductive trace comprises forming a linear trace and connecting the plurality of leg traces to the linear trace at intervals equaling $m\lambda/2$, wherein m is a whole natural number.

16. The method of claim 14, wherein forming the main conductive trace comprises forming a circular patch.

17. The method of claim 16, further comprising connecting an output lead to the center of the circular patch.

18. A method for operating a plurality of radiation sources for steering a radiation beam from a receiver, comprising:

activating a switch to couple a first radiation sources to the receiver and decoupled all other radiation sources from the receiver, and receiving radiation solely from the first radiation source;

activating the switch to couple a second radiation source to the transceiver without decoupling the first radiation source from, the transceiver, and receiving radiation from the first and second radiation sources in additive mode;

decoupling the first radiation source from the receiver, and receiving radiation solely from the second radiation source.

* * * * *